United States Patent [19]

Vanassche et al.

[11] 4,108,661

[45] Aug. 22, 1978

[54] LIPPMANN-EMULSIONS AND REVERSAL PROCESSING THEREOF

[75] Inventors: Willy Joseph Vanassche, Kontich; Herman Adelbert Philippaerts; René Omer Duville, both of Edegem; Francois Leon Schelfaut, St. Niklaas, all of Belgium

[73] Assignee: Agfa-Gevaert, N.V., Mortsel, Belgium

[21] Appl. No.: 747,344

[22] Filed: Dec. 3, 1976

[30] Foreign Application Priority Data

Dec. 12, 1975 [GB] United Kingdom ..... 51088/75

[51] Int. Cl.[2] ..... G03C 5/50; G03C 1/28

[52] U.S. Cl. ..... 96/59; 96/107; 96/94 R; 96/95

[58] Field of Search ..... 96/59, 94, 107, 95, 96/64

[56] References Cited

U.S. PATENT DOCUMENTS

| | | | |
|---|---|---|---|
| 3,178,282 | 4/1965 | Luckey et al. | 96/59 |
| 3,501,305 | 3/1970 | Illingsworth | 96/107 |
| 3,501,307 | 3/1970 | Illingsworth | 96/107 |
| 3,537,858 | 11/1970 | Wise | 96/107 |
| 3,652,280 | 3/1972 | De Belder et al. | 96/64 |
| 3,841,877 | 10/1974 | Willems et al. | 96/59 |
| 3,892,574 | 7/1975 | Claes | 96/107 |
| 3,942,986 | 3/1976 | Florens | 96/107 |
| 3,963,493 | 6/1976 | Vanassche | 96/107 |

*Primary Examiner*—Mary F. Kelley
*Attorney, Agent, or Firm*—A. W. Breiner

[57] ABSTRACT

A photographic material is described for making positive images by reversal processing, the material comprising a support and a silver halide Lippmann-emulsion layer the average silver halide grain-size of which is less than 100 nm wherein the grains have been chemically sensitized to fog so that a test portion of the emulsion when coated on a support at a coverage of silver halide corresponding to from about 3 g to about 7 g of silver nitrate per sq.m. gives a density between about 0.20 and about 0.70 upon development without exposure for 6 min at 20° C in a developer of the composition:

hydroquinone: 16.5 g
potassium bromide: 1.7 g
sodium salt of EDTA: 1.7 g
potassium metabisulphite: 40 g
1-phenyl-5-mercaptotetrazole: 35 g
sodium hydroxide and water to make: 1 liter at pH 11.8

4 Claims, No Drawings

LIPPMANN-EMULSIONS AND REVERSAL PROCESSING THEREOF

The present invention relates to Lippmann-emulsions and to reversal processing thereof after image-wise exposure.

Lippmann-emulsions, having an average grain-size of less than 0.1 μm (100 nm) are of particular importance for the preparation of photographic plates or films with high resolution, for use in microphotography, for recording nucleophysical phenomenons, for the preparation of masks in the production of microelectronic integrated circuits, for use in holography, for high-density data storage, etc.

In the production of microelectronic integrated circuits, drawings are made on highly enlarged scale of the various successive masks necessary to produce one integrated circuit whereupon the drawings are reduced, if necessary in successive steps, and reproduced on a photographic plate or film material forming thereby the mask ready for use. By various photographic and chemical steps (photo-etching of lacquered plates) the images of the masks thus produced are transferred to the surface on which the integrated circuit is to be made, in order to produce the required circuit elements.

The photographic materials for use in the production of masks as described above should have a high resolving power and acutance and allow a correct reproduction of the dimensions of the image. Unless the dimensional reproduction is kept within the accepted tolerances the masks will be useless because it will not enable electronic components to be formed in the circuitry with the required high degree of accuracy. Developments in the field of computer and telecommunication systems create the need for ever increasing packing densities on the circuit elements and therefore it has become common practice to reproduce image details e.g. lines and slits having geometrical widths even smaller than the emulsion thickness e.g. smaller than 5 μm.

These image details should also be reproduced within the accepted width tolerances of at most 10% respective to the geometrical width of the original dimensions.

In the reproduction of very small details a number of problems are encountered e.g. image-spreading, adjacency effects, edge effects etc. which render accurate reproduction difficult so that special precautionary measures should be taken e.g. incorporating into the Lippmann emulsion light-absorbing dyes to reduce scattering of the exposure light within the emulsion layer or reflection of the exposure light at the support as described in British Pat. No. 1,298,335 and incorporating compounds reducing image distortions and promoting edge sharpness as described in the published German Patent Applications Nos. (DOS) 2,161,045, 2,254,357, 2,254,358 and 2,255,032.

Even if these measures are taken the accuracy of reproduction of very small image details may remain insufficient for certain work, especially when reversal processing is applied to form positive masks. In microelectronic mask-making it is not only common practice to produce by negative processing images which are negative with respect to the original pattern but also images which are positive with respect to such original by reversal processing. Indeed, it is often difficult to position a mask produced by negative processing into register with integrated circuits, to which the images of previous masks have already been transferred, when image-details of the latter masks are smaller in size than the black image-details of the negative mask and thus are entirely hidden by the said black image-details. Proper registering can be achieved in these instances by the use of masks produced by reversal processing because the black image areas of the mask obtained on negative processing are fully transparent on reversal processing.

Reversal processing as is known in the art comprises the steps of developing the image-wise exposed emulsion to form a negative silver image, bleaching this silver image in the exposed and developed areas and then developing the remaining silver halide on the non-exposed and thus nondeveloped areas to produce a positive silver image, the said remaining silver halide being made developable by fogging before or during this development e.g. by an overall re-exposure before the development or by addition of a silver halide fogging agent to the developer.

Whereas for forming a negative image it suffices that a silver image of sufficient density is formed at the surface portion of the emulsion layer, the production of positive images by reversal require that the image-wise exposure and first development are such that all silver halide in the exposed areas is developed throughout the entire emulsion thickness because no photo-sensitive silver halide should be left in the image areas after bleaching.

If any silver halide remains in the areas exposed in the first exposure step, developed silver will form in those areas by the second development steps with the result that the areas of the positive image which should be clear will show undesirable fog.

In order to cause in the image-wise exposed areas the reduction of substantially all silver halide throughout the entire thickness of the emulsion, it does not suffice that the exposure intensity is high enough in order to ensure that the emulsion is affected through its full depth in exposed areas, but the first development should be such that full development of the exposed areas throughout the entire emulsion thickness is obtained. For full development the first developer in reversal processing usually comprises one or more silver halide solvents e.g. high amounts of potassium bromide and thiocyanates e.g. potassium thiocyanate to promote solution physical development.

Whereas the use of such developers with high content of silver halide solvent in the reversal processing of common silver halide materials are highly satisfactory, they do not allow correct reproduction of image details, especially details having a geometrical width of 5 μm or less when used in the reversal processing of Lippmann-emulsions by means of developers having high content of silver halide solvent not only promote development at the exposed areas of all silver halide throughout the entire emulsion thickness but also cause solution physical development in the adjacent non-exposed areas.

From the foregoing it is apparent that correct reproduction of image details by reversal processing of Lippmann emulsion is more difficult to achieve than by negative processing not only because the intensity of the image-wise exposure should be higher which results in increased light-scattering and reflection, but also because the first development should be a full development using developers containing silver halide solvents causing solution physical development in adjacent non-exposed areas.

When the first development in the reversal process is a full development it is difficult to achieve accurate negative reproduction of the original image dimensions, and the inevitable result of inaccuracy at that stage is inaccurate positive reproduction of the said image dimensions in the subsequent steps of reversal processing.

On the other hand if care is taken that the first development in the reversal processing is such to form a negative image of the original with sufficiently accurate reproduction of the image dimensions, it often happens that not all silver halide is developed in the exposed areas with the result that after the subsequent steps of reversal processing the positive image shows in the highlight areas undesirable fog.

The present invention basically resides in the provision of photographic material comprising a support and a silver halide Lippmann emulsion layer forming upon image-wise exposure and development a negative image wherein the silver halide grains of the emulsion have been slightly fogged chemically e.g. by sensitization, preferably reduction sensitization, to fog. The invention also includes the use of such a material in the production of a reversal image by reversal processing.

Due to the use of a slightly fogged Lippamnn emulsion according to the invention, it is possible to obtain full development in the exposed areas of all silver halide throughout the emulsion thickness with acceptable tolerances for the dimensions of the negative image thus produced. Consequently it is much easier to form positive reproductions of small image-details within acceptable tolerances without significant fog in the highlight areas.

Due to the use of a fogged emulsion, any active silver halide that would otherwise remain in the image-wise exposed areas if the negative image-forming steps of reversal processing are such to form an accurate negative reproduction of the image dimensions is itself developed to silver which is then bleached in the subsequent bleaching step. Although development of fogged silver halide to silver will take place also in the non-exposed areas during development of the negative image, any such silver is bleached in the subsequent bleaching step and the emulsion can be fogged so that sufficient silver halide remains in these non exposed areas to permit a positive silver image of the desired density to be formed.

Thus the invention includes in particular a method of forming a reversal image of an original in a photographic material comprising a slightly fogged silver halide Lippmann emulsion layer according to the invention as above defined, wherein the emulsion is image-wise exposed and subjected to development to convert all silver halide to silver through the full thickness of the emulsion layer in the exposed areas, the developed silver is then bleached, and the active silver halide then still remaining in the emulsion is converted to form a positive image.

The negative-image forming steps of the reversal processing are carried out so as to form a negative image with high edge sharpness and without intolerable image-spreading relative to the original, and nevertheless a reversal image with clear highlights is formed by the subsequent positive-image forming steps.

During the bleaching step, any silver which has been formed in the non-exposed areas by development of fogged silver halide grains also becomes bleached.

The silver halide grains of the Lippmann-emulsion are only slightly fogged so that sufficient silver halide remains in the non-exposed areas after image-wise exposure and negative development to form the reversal image in the subsequent steps.

The present invention thus provides more particularly a photographic material comprising a support and a silver halide emulsion layer, wherein the grains have been chemically fogged or chemically sensitized to fog, so that a test portion of the emulsion when coated on a support at a coverage of silver halide corresponding to from about 3 g to about 7 g of silver nitrate per sq.m. gives a density between about 0.20 and about 0.70 upon development without exposure for 6 min at 20° C in a developer of the composition:

hydroquinone: 16.5 g
potassium bromide: 1.7 g
sodium salt of EDTA: 1.7 g
potassium metabisulphite: 40 g
1-phenyl-5-mercapto-tetrazole: 35 g
sodium hydroxide and water to make: 1 litre with pH 11.8

The present invention also provides a method for producing reversal images by image-wise exposure and reversal processing of a photographic material containing a silver halide emulsion layer the silver halide grains of which have an average grain diameter of less than 100 nm, wherein the said silver halide emulsion layer comprises silver halide grains which have been chemically fogged e.g. sensitized to fog to the level above defined.

The fogged Lippmann-emulsions for producing by reversal processing positive reproductions of the original are no direct-positive emulsions yielding upon exposure and development direct-positive images since a negative latent image is formed by image-wise exposure.

The preferred materials for reversal processing according to the present invention comprise a Lippmann-emulsion the average silver halide grain-size of which is at most 100 nm.

Silver halide Lippmann-emulsions may be prepared according to methods well known in the art and described in the literature (see e.g. P. Glafkides, "Photographic Chemistry", Vol. I, 1958, pages 365–368, Mees/James "The theory of the Photographic Process", 1966, p. 36 and National Physical Laboratory "Notes on Applied Science" no. 20: "Small Scale Preparation of Fine-Grain (Colloidal) Photographic emulsions", B. H. Crawford, London, (1960). They may also be prepared according to the technique described in U.S. Pat. No. 3,801,326.

Silver halide Lippmann-emulsions with very fine grain can be obtained by effecting the precipitation of the silver halide in the presence of heterocyclic mercapto compounds as described in British Pat. No. 1,204,623, heterocyclic mercapto precursor compounds as described in the published German Patent Application No. 2,161,044, compounds of the type described in U.S. Pat. Nos. 3,661,592 and 3,704,130, compounds of the type described in the Feb. 1972 issue of "Research Disclosures", Disclosure RD 9401, Industrial Opportunities Limited, Havant, Hampshire, England.

The thickness of the emulsion layer of a photographic material according to the present invention is preferably comprised between about 3 μm and about 8 μm, and the average grain size of the silver halide grains is preferably less than 80 nm. The ratio of silver halide to hydrophilic colloid binder is preferably at least 1:2 and at most 4:1.

Various silver salts may be used as the light-sensitive salt such as silver bromide, silver iodide, silver chloride, or mixed silver halides such as silver chlorobromide, silver bromoiodide and silver chlorobromoiodide. Silver bromide and silver bromoiodide emulsions, having a iodide content of at most 8 mole %, the average grain-size of which is at most 80 nm are favoured.

The hydrophilic colloid binder used as the vehicle for the silver halide may be any of the common hydrophilic colloids employed in photographic light-sensitive emulsions for example, gelatin, albumin, zein, casein, alginic acid, collodion, a cellulose derivatives such as carboxymethyl cellulose, a synthetic hydrophilic colloid such as polyvinyl alcohol and poly-N-vinyl pyrrolidone, etc. If desired compatible mixtures of two or more colloids may be employed for dispersing the silver halide.

The light-sensitive silver halide emulsions according to the present invention are chemically sensitized according to any of the accepted procedures until a suitable fog level, preferably a level as defined hereinbefore, is obtained. They are preferably sensitized until fog by means of reductors e.g. hydrazine, hydroxylamine, tin(II) compounds e.g. tin(II) chloride, tin complexes and tin chelates of the (poly)amino (poly)carboxylic acid type as described in British patent specification No. 1,209,050, ascorbic acid, formaldehyde, thiourea dioxide, polyamines such as diethylene triamine, phosphonium salts such as tetra(hydroxymethyl)phosphonium chloride, bis (p-aminoethyl) sulphide and its water-soluble salts, etc. Preferred reducing agents are thiourea dioxide and tin(II) chloride.

Reduction sensitization can also be effected by digestion at low pAg values as described by Wood, J. Phot. Sci I (1953) 163.

In addition to reduction sensitization by means of a reducing agent or low pAg values, compounds of a metal more electropositive than silver can be used which include gold compounds e.g. potassium tetrachloroaurate, auric trichloride, and potassium aurithiocyanate, as well as compounds of rhodium, ruthenium, platinum, iridium, and palladium e.g. ammonium hexachloropalladate and potassium chloroiridate. Preferred noble metal compounds are gold compounds.

In the reversal processing of image-wise exposed Lippmann material according to the present invention the image-wise exposed material is first developed to provide a negative image the dimensions of which can be kept within the accepted width tolerances. Any of the common developers used for negative processing can be used for this purpose. However, it is preferred to use developing solutions producing strong Eberhard effects and having little silver halide dissolving action, by means of which small-image details, e.g. details having a geometrical width of 5 μm or less, are reproduced in the form of a negative image with high contrast gradient and edge sharpness and with dimensions relative to the dimensions of the original which are within the accepted width tolerances of at most 10%.

Particularly suitable developers for forming the negative image are developers of high pH values, preferably at least pH 11,5 and comprising hydroquinone as the sole developing agent in amounts higher dan 10 g, preferably higher than 15 g per litre. The developer preferably comprises no thiocyanate or thiosulphate silver halide solvent or at least less than 2 g per litre, potassium bromide in amounts less than 10 g, preferably less than 5 g per litre and free sulphite ions (provided by addition to the developer of sulphites, bisulphites and/or metabisulphites) in an amount of at least 50 g per litre. These developers also comprise preferably one or more development restrainers e.g. 5-nitroindazole, 5-nitrobenzimidazole or 5-nitrobenztriazole and 6-methylbenztriazole, mercapto-compounds which include aliphatic, aromatic and heterocyclic mercapto compounds e.g. mercaptotetrazoles, mercaptotriazoles, mercaptothiadiazoles, mercaptooxadiazoles, mercaptothiazoles and benzthiazoles mercaptooxazoles and benzoxazoles, mercaptopyrimidines, mercaptotriazines, etc. representatives of which are well known to those skilled in the art of silver halide photography. A preferred compound is 1-phenyl-5-mercaptotetrazole.

After the first development, the material is treated to bleach the negative silver image. Any silver or fog which was produced in the non-exposed areas is also bleached in this step. Thereafter remaining silver halide is rendered developable and developed to form the positive image by the common procedures used in reversal processing. This preferably occurs by an overall re-exposure of the bleached material followed by development but as is known in the art, it is possible to replace the re-exposure and second development steps by development under fogging conditions e.g. in a developer comprising a silver halide reducing agent.

The Lippmann-emulsions of the present invention comprising slightly fogged silver halide grains may be spectrally sensitized by any of the known spectral sensitizers such as cyanines and merocyanine dyes for photographic light-sensitive silver halide materials. The silver halide emulsions according to the present invention are most advantageously sensitized for the green region of the spectrum. The exposure light is preferably chosen so that it radiates light of a wavelength to which the emulsion has been spectrally sensitized.

Particularly suitable merocyanine dyes for spectrally sensitizing the Lippmann-emulsions used according to the present invention have been described in British Pat. Nos. 654,683 — 904,332 — 1,090,626 — 1,298,335, in U.S. Pat. Nos. 2,526,632 — 3,705,038 — 3,752,673 — 3,765,900 — 3,765,901, in Belgian Pat. Nos. 568,840 — 654,816 — 662,796 — 701,921 — 716,831 — 723,720, French Pat. Nos. 942,838 — 994,762 — 1,017,981, etc.

The emulsions may also comprise compounds which sensitize the emulsion by development acceleration for example compounds of the polyoxyalkylene type such as alkylene oxide condensation products as described among others in U.S. Pat. Nos. 2,531,832 and 2,533,990, in British Pat. Nos. 920,637 — 940,051 — 945,340 and 991,608 and in Belgian Pat. No. 648,710 and the known onium compounds including quaternary ammonium, quaternary phosphonium and ternary sulphonium compounds as well as onium derivatives of amino-N-oxides as described in United Kingdom Pat. No. 1,121,696.

Further the emulsion may comprise stabilizers e.g. heterocyclic nitrogen-containing thioxo compounds such as benzothiazoline-2-thione and 1-phenyl-2-tetrazoline-5-thione and compounds of the hydroxytriazolopyrimidine type. They can also be stabilized with mercury compounds such as the mercury compounds described in Belgian Pat. Nos. 524,121 and 677,337, British Pat. No. 1,173,609 and in U.S. Pat. No. 3,179,520.

The emulsion may further comprise compounds which reduce image distortions and promote edge sharpness e.g. of the type described in the published German Patent Application Nos. 2,161,045 — 2,254,357 — 2,254,358 and 2,255,032.

Any of the hardening agents for hydrophilic colloids may be used in the emulsions according to the present invention such as chromium, aluminum and zirconium salts, formaldehyde, dialdehydes, hydroxyaldehydes, acrolein, glyoxal, halogen substituted aldehyde acids such as mucochloric acid and mucobromic acid, diketones such as divinyl ketone, compounds carrying one or more vinylsulphonyl groups such as divinylsulphone, 1,3,5-trivinylsulphonylbenzene, hexahydro-s-triazines carrying vinylcarbonyl, halogenacetyl and/or acyl groups such as 1,3,5-triacryloylhexahydro-1,3,5-triazine, 1,3-diacryloyl-5-acetyl-hexahydro-1,3,5-triazine, 1,3,5-trichloroacetyl-hexahydro-1,3,5-triazine, etc.

The emulsions may also comprise light-absorbing dyes which are so chosen that they absorb light of the wavelength to which the material is exposed so that scattering and reflection of light within the photographic material is reduced. For more details regarding these dyes there can be referred to Belgian Pat. No. 699,375 and the patent literature referred to therein, and to U.S. Pat. No. 3,652,280. The dyes are preferably used in such amounts that per micron of emulsion layer thickness a density comprised between 0.05 and 0.20, measured in the spectral region of the exposure light, is obtained.

It may further be advantageous to provide between the support and the emulsion layer an antihalation coating as described in the May 1974 issue of "Research Disclosure", Disclosure RD 12 106, Industrial Opportunities Limited, Havant, Hampshire, England.

The emulsions may be coated on a wide variety of photographic emulsion supports. Typical supports include cellulose ester film, polyvinyl acetal film, polystyrene film, polyethylene terephthalate film and related films of resinous materials as well as paper and glass. In the manufacture of high resolution plate materials for the preparation of masks for use in the electronic industry, glass supports are most advantageously used in view of their high dimensional stability.

In order to promote adhesion of the emulsion layer to glass supports in the preparation of high resolution plate materials, the silicon compounds described in British Pat. No. 1,286,467 can be incorporated into the emulsion.

The light-sensitive emulsions may be coated by various coating techniques including dip-coating, air-knife coating, curtain coating, extrusion coating, whirl- or spin-coating or by vacuum evaporation.

Though the invention has been particularly described in view of the preparation of masks as used in the production of microelectronic integrated circuits, the same favourable effects are obtained by reversal processing according to the invention of Lippmann-materials used for other purposes where accurate reproduction of very small image details is of primary importance.

The following example illustrates the present invention:

EXAMPLE

Two silver bromoiodide Lippmann-emulsions having an average grain diameter of 50 nm were prepared. One was reduction and gold sensitized until the optimum sensitivity fog relationship was reached whereas the other was reduction gold sensitized until fog so that when coated on a support at a coverage of 5 g of silver nitrate per sq.m. and developed without exposure for 6 min at 20° C in a developer of the composition:

hydroquinone: 16.5 g
potassium bromide: 1.7 g
sodium salt of EDTA: 40 g
1-phenyl-5-mercapto-tetrazole: 35 g
sodium hydroxide and water to make: 1 liter with pH 11.8

An overall density of 0.25 was obtained.

To each of the emulsions a spectral sensitizer for the green region of the spectrum was added as well as a light-screening dye in an amount corresponding to a density (measured in the green spectral region) of 0.07 μm of layer thickness.

The emulsions were coated on a glass support and dried.

After contact exposure of the plates through a chromium mask using a band filter with band width of 52 nm and peak transmission at 525 nm, the plates were reversal processed according to the following procedure:

development for 6 min at 20° C in a developer of the composition:

hydroquinone: 25 g
potassium bromide: 2.5 g
sodium salt of EDTA: 2.5 g
potassium metabisulphite: 62.5 g
1-phenyl-5-mercaptotetrazole: 50 mg
potassium thiocyanate: 0.5 g
sodium hydroxide and water to make: 1 liter at pH 11.8 bleaching for 5 min at 20° C in a bleach of the composition:

potassium dichromate: 5 g
strong sulphonic acid (d = 1.85): 10 ml
water to make: 1 liter rinsing for a few minutes followed by clearing for 5 min at 20° C in a bath comprising 100 g of sodium sulphite per liter, rinsing for a few minutes followed by overall re-exposure and development for 6 min at 20° C in a developer of the composition given for the above negative processing.

The line-broadening for the slits of 3 μm is listed in the following table. The minimum and maximum densities are also listed.

Table

| Plate | Line-broadening | $D_{min}$ | $D_{max}$ |
|---|---|---|---|
| not-fogged | 0.2 μm | 0.25 | >5.00 |
| fogged | none | 0.03 | 4.20 |

We claim:

1. In a method of producing a reversal image of an original wherein a photographic material comprising a support and a silver halide Lippmann-emulsion layer the average silver halide grain-size of which is less than 100 nm, is subjected to the following steps: (a) image-wise exposure; (b) developing said image-wise exposed emulsion layer to form a negative silver image; (c) bleaching said negative silver image in the exposed and developed areas, and (d) thereafter rendering by an overall exposure the remaining undeveloped silver halide developable and developing said remaining silver halide or developing the material again in a developer composition comprising a silver halide reducing agent, the improvement which comprises using an emulsion the silver halide grains of which have been chemically sensitized to fog so that a test portion of the emulsion when coated on a support at a coverage of silver halide corresponding to from about 3 g to about 7 g of silver nitrate per sq.m gives a density between about 0.20 and about 0.70 upon development without any exposure for 6 min at 20° C. in a developer of the composition:

hydroquinone: 16.5 g
potassium bromide: 1.7 g
sodium salt of EDTA: 1.7 g
potassium metabisulphite: 40 g
1-phenyl-5-mercaptotetrazole: 35 g
sodium hydroxide and water to make: 1 liter at pH 11.8.

2. Method according to claim 1, wherein said first development step is by means of a developing composition, the pH of which is at least 11.5, comprising hydroquinone as the sole developing agent in an amount of at least 10 g per liter, a thiocyanate or thiosulphate silver halide solvent in an amount of from 0 to 2 g per liter, potassium bromide in an amount of at most 10 g per liter and free sulphite ions in an amount of at least 50 g per liter.

3. Method according to claim 2, wherein the developing composition also comprises a development restraining compound.

4. Method according to claim 3, wherein the development restraining compound is 1-phenyl-5-mercaptotetrazole.

* * * * *